US011326785B2

(12) United States Patent
Kageyama et al.

(10) Patent No.: US 11,326,785 B2
(45) Date of Patent: May 10, 2022

(54) HEATING AND HOT-WATER-SUPPLY APPARATUS

(71) Applicant: NORITZ CORPORATION, Hyogo (JP)

(72) Inventors: Akihisa Kageyama, Hyogo (JP); Hiroshi Morimoto, Hyogo (JP); Takehito Yokoyama, Hyogo (JP); Yasutaka Kuriyama, Hyogo (JP); Yoshihisa Kitano, Hyogo (JP); Yasushi Morita, Hyogo (JP); Toshihiro Kawachi, Hyogo (JP); Midori Yokoyama, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 286 days.

(21) Appl. No.: 16/500,397

(22) PCT Filed: Apr. 24, 2018

(86) PCT No.: PCT/JP2018/016604
§ 371 (c)(1),
(2) Date: Oct. 2, 2019

(87) PCT Pub. No.: WO2018/199089
PCT Pub. Date: Nov. 1, 2018

(65) Prior Publication Data

US 2021/0102713 A1 Apr. 8, 2021

(30) Foreign Application Priority Data

Apr. 25, 2017 (JP) ..... JP2017-086004

(51) Int. Cl.
*F24D 19/10* (2006.01)
*F24D 3/02* (2006.01)
(Continued)

(52) U.S. Cl.
CPC ..... *F24D 19/1081* (2013.01); *F24D 3/02* (2013.01); *F24D 3/082* (2013.01); *F24D 17/0031* (2013.01)

(58) Field of Classification Search
CPC ..... F24D 3/082; F24D 19/1081; F24D 3/02; F24D 17/0031; F24D 3/08; F24H 1/52
See application file for complete search history.

(56) References Cited

U.S. PATENT DOCUMENTS

2018/0120824 A1* 5/2018 Shimada ..... G05B 19/042

FOREIGN PATENT DOCUMENTS

CN 101981387 2/2011
GB 1543546 4/1979
(Continued)

OTHER PUBLICATIONS

"International Search Report (Form PCT/ISA/210)" of PCT/JP2018/016604, dated Jul. 17, 2018, with English translation thereof, pp. 1-4.

*Primary Examiner* — Steven B McAllister
*Assistant Examiner* — John E Bargero
(74) *Attorney, Agent, or Firm* — JCIPRNET

(57) ABSTRACT

A heating and hot-water-supply apparatus is provided with: a control unit that performs control on the basis of detection parameters of a plurality of detection means installed at the aforementioned locations and a setting parameter set in an operation unit. The distribution means can adjust the distribution ratio so as to correspond to a heating operation, a hot-water supply operation, and the simultaneous heating and hot-water-supply operation. The control unit prohibits the simultaneous heating and hot-water-supply operation in a case in which the required heating capacity for the hot-water supply operation calculated on the basis of the detec-
(Continued)

tion parameters and the setting parameter is equal to or greater than a predetermined standard capacity.

4 Claims, 3 Drawing Sheets

(51) Int. Cl.
*F24D 3/08* (2006.01)
*F24D 17/00* (2022.01)

(56) References Cited

FOREIGN PATENT DOCUMENTS

| | | |
|---|---|---|
| JP | H04371750 | 12/1992 |
| JP | 2001255001 | 9/2001 |
| JP | 2006112785 | 4/2006 |
| JP | 2008039346 | 2/2008 |
| JP | 2011-515647 | 5/2011 |
| JP | 2014163590 | 9/2014 |
| JP | 2018071925 | 5/2018 |

* cited by examiner

HEATING AND HOT-WATER-SUPPLY APPARATUS

CROSS-REFERENCE TO RELATED APPLICATION

This application is a 371 application of the International PCT application serial no. PCT/JP2018/016604, filed on Apr. 24, 2018, which claims the priority benefits of Japan Patent Application JP2017-086004, filed on Apr. 25, 2017. The entirety of each of the above-mentioned patent applications is hereby incorporated by reference herein and made a part of this specification.

TECHNICAL FIELD

The present invention relates to a heating and hot-water-supply apparatus which is capable of executing a heating operation for heating a heating heat medium using combustion heat to perform heating and a hot water supply operation for heating tap water through heat exchange with the heating heat medium to perform hot water supply, and more particularly, to a heating and hot-water-supply apparatus which is capable of simultaneously executing a heating operation and a hot water supply operation.

BACKGROUND ART

Hitherto, heating and hot-water-supply apparatuses capable of executing a heating operation and a hot water supply operation in a switching manner have been widely used. Such a heating and hot-water-supply apparatus includes a combustion means, a heat exchanger, a circulation passage which connects the heat exchanger and a heating terminal installed indoors, a circulation pump which is provided in the circulation passage, a bypass passage which branches from the circulation passage and bypasses the heating terminal, and the like. A switching means capable of performing switching so that a heating heat medium flows through the circulation passage or the bypass passage is provided in a branch part between the circulation passage and the bypass passage. A heat exchanger for supplying hot water is provided in the bypass passage, and a water supply passage for supplying tap water to the heat exchanger for supplying hot water and a hot water supply passage for supplying hot water to a hot-water tap or the like from the heat exchanger for supplying hot water are connected thereto.

The heating heat medium made to flow by operating the circulation pump is heated using combustion heat of the combustion means in the heat exchanger. When the heating operation is performed, the switching means is switched such that the heating heat medium flows through the circulation passage in order to use the heated heating heat medium in the heating terminal. The heated heating heat medium flows through the circulation passage to discharge heat in the heating terminal and returns to the heat exchanger.

When the hot water supply operation is performed, the switching means is switched such that the heating heat medium flows through the bypass passage in order to use the heated heating heat medium in the heat exchanger for supplying hot water. Tap water supplied from the water supply passage is heated through heat exchange with the heating heat medium in the heat exchanger for supplying hot water. The heating heat medium that has exchanged heat with tap water in the heat exchanger for supplying hot water returns to the heat exchanger. Hot water heated in the heat exchanger for supplying hot water is supplied from the hot-water tap or the like through the hot water supply passage.

In order to eliminate such inconvenience that it is not possible to simultaneously perform a heating operation and a hot water supply operation of a heating and hot-water-supply apparatus that performs a heating operation and a hot water supply operation in a switching manner, a configuration in which a distribution device is provided instead of a switching means is known as in, for example, Patent Literature 1. Since the heating heat medium is distributed into a heating heat medium for a heating operation and a heating heat medium for a hot water supply operation by a distribution device, it is possible to simultaneously perform a heating operation and a hot water supply operation.

CITATION LIST

Patent Literature

[Patent Literature 1] Published Japanese Translation No. 2011-515647 of the PCT International Publication

SUMMARY

Technical Problem

However, in a heating and hot-water-supply apparatus disclosed in Patent Literature 1, there is a concern that a heating capacity for performing a simultaneous heating and hot-water-supply operation may be insufficient in a case where a hot water supply load increases due to an increase in the flow rate of hot water supply or a decrease in the temperature of tap water, for example, during a simultaneous heating and hot-water-supply operation. In addition, a heating capacity for performing a simultaneous heating and hot-water-supply operation may be insufficient due to an actual decrease in heating capacity caused by a defect of equipment, or the like.

Such an insufficient heating capacity of a simultaneous heating and hot-water-supply operation may result in lower temperature heating than a user's desired temperature and hot water supply at low temperature or hot water supply at a low flow rate. Particularly, in a case where hot water supply cannot be used comfortably, it is not preferable because inconvenience or discomfort felt by a user is generally significant as compared to heating.

An objective of the present invention is to provide a heating and hot-water-supply apparatus which is capable of prohibiting a simultaneous heating and hot-water-supply operation by determining insufficiency of a heating capacity during the simultaneous heating and hot-water-supply operation in a heating and hot-water-supply apparatus capable of performing a heating operation, a hot water supply operation, and a simultaneous heating and hot-water-supply operation.

Solution to Problem

A heating and hot-water-supply apparatus of a first aspect includes combustion means, a heat exchanger, a circulation passage which connects the heat exchanger and an external heating terminal, a circulation pump which is provided in the circulation passage, a bypass passage which branches from the circulation passage and bypasses the heating terminal, distribution means which is provided in a branch part between the circulation passage and the bypass passage, a heat exchanger for supplying hot water which is provided in the bypass passage, a water supply passage for supplying tap water to the heat exchanger for supplying hot water, a hot water supply passage for supplying hot water heated by the heat exchanger for supplying hot water at a predetermined hot water supply set temperature, a plurality of detection means, an operation part for performing a predetermined operation, and a control part for performing control based on setting parameters set by the operation part and detection parameters detected by the plurality of detection means, in which the distribution means is configured such that a distribution ratio is adjustable so as to be adaptable to a heating operation, a hot water supply operation, and a simultaneous heating and hot-water-supply operation, and the control part is configured to calculate a necessary heating capacity required for the hot water supply operation on the basis of the setting parameters and the detection parameters and prohibit the simultaneous heating and hot-water-supply operation in a case where the necessary heating capacity is equal to or greater than a predetermined reference capacity.

According to the above-described configuration, the control part calculates the necessary heating capacity required for the hot water supply operation on the basis of a plurality of parameters, and prohibits the simultaneous heating and hot-water-supply operation because there is a concern that a heating capacity at the time of the simultaneous heating and hot-water-supply operation may be insufficient in a case where the calculated necessary heating capacity is equal to or greater than a predetermined reference capacity. Therefore, it is possible to give a margin to a heating capacity for performing the hot water supply operation by setting a predetermined reference capacity on the basis of a hot water supply capacity of the heating and hot-water-supply apparatus and to stably supply hot water by performing heating so as to follow a fluctuation in a hot water supply load, and thus a user can be prevented from feeling inconvenience or discomfort.

In a heating and hot-water-supply apparatus of a second aspect according to the invention of the first aspect, the control part may be configured to give notice of prohibition of the simultaneous heating and hot-water-supply operation through the operation part in a case where the simultaneous heating and hot-water-supply operation is prohibited.

According to the above-described configuration, since the user is notified of the prohibition of the simultaneous heating and hot-water-supply operation, it is possible to reduce discomfort felt by the user due to inability to simultaneously use heating and hot water supply. In addition, it is advantageous for the user to take a measure for avoiding the prohibition of the simultaneous heating and hot-water-supply operation.

In a heating and hot-water-supply apparatus of a third aspect according to the invention of the first or second aspect, the control part may be configured to execute the hot water supply operation in a case where a request for performing both the heating operation and the hot water supply operation has been given when the simultaneous heating and hot-water-supply operation is prohibited.

According to the above-described configuration, since the hot water supply operation is executed in a case where a request for performing the heating operation and the hot water supply operation has been given in a state where the simultaneous heating and hot-water-supply operation is prohibited, the user can be prevented from feeling inconvenience or discomfort due to the hot water supply operation not being executed.

Advantageous Effects of Invention

According to the present invention, it is possible to provide a heating and hot-water-supply apparatus which is capable of prohibiting a simultaneous heating and hot-water-supply operation by determining insufficiency of a heating capacity during the simultaneous heating and hot-water-supply operation in a heating and hot-water-supply apparatus capable of performing a heating operation, a hot water supply operation, and a simultaneous heating and hot-water-supply operation.

DESCRIPTION OF THE EMBODIMENTS

Hereinafter, an embodiment for implementing the present invention will be described on the basis of an example.

Example

Figure 1:
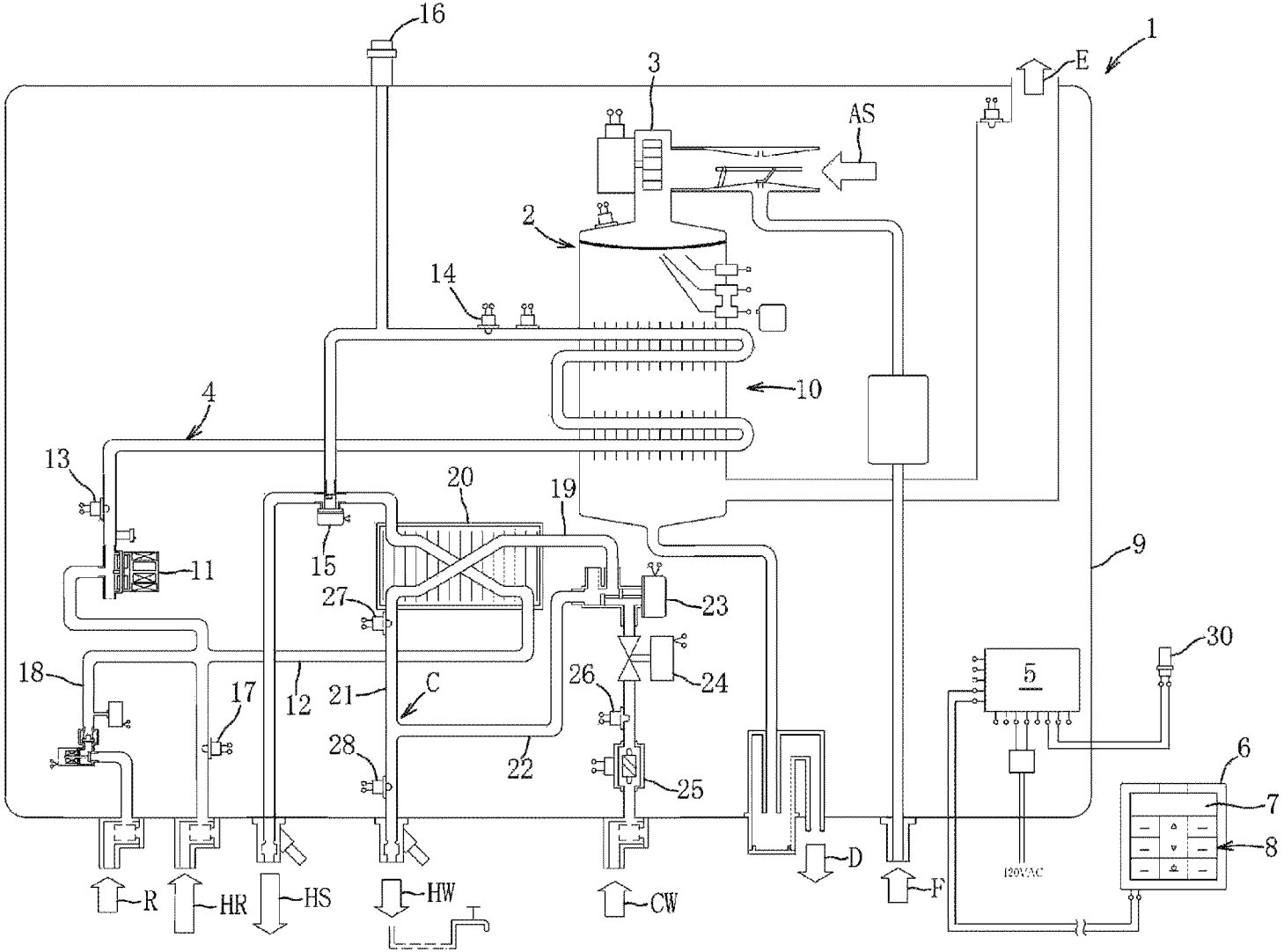
FIG. 1 is a schematic diagram of a heating and hot-water-supply apparatus of the present invention.

First, an overall configuration of a heating and hot-water-supply apparatus 1 of the present invention will be described on the basis of FIG. 1.

The heating and hot-water-supply apparatus 1 is configured to perform a heating operation by circulating a heating heat medium heated using combustion heat of a combustion part 2 between the apparatus and a heating terminal (not shown) installed in a room outside the heating and hot-water-supply apparatus 1 and to perform a hot water supply operation for supplying hot water by adjusting a temperature of tap water heated using heat of the heating heat medium to a hot water supply set temperature.

The heating and hot-water-supply apparatus 1 includes the combustion part 2 which is a combustion means, a heat exchanger 10, a circulation passage 4 that connects the heat exchanger 10 and a heating terminal provided indoors, a circulation pump 11 which is provided upstream of the heat exchanger 10 in the circulation passage 4, and the like. The combustion part 2 includes a blower fan 3 which mixes an air supply indicated by an arrow AS and a fuel gas indicated by an arrow F and burns a mixed gas supplied by the blower fan 3. The amount of combustion gas generated (the amount of combustion heat) is adjusted by controlling a rotation speed of the blower fan 3. The heat exchanger 10 heats the heating heat medium by exchanging heat between the combustion gas generated in the combustion part 2 and the heating heat medium. The combustion gas of which the temperature has fallen due to the heat exchange is exhausted to the outside as indicated by arrows D and E.

In addition, the heating and hot-water-supply apparatus 1 includes a first bypass passage 12 (bypass passage), a heat exchanger 20 for supplying hot water provided in the first bypass passage 12, a water supply passage 19, a hot water supply passage 21, and the like. The first bypass passage 12 branches from the circulation passage 4 on a downstream side of the heat exchanger 10 to bypass the heating terminal and joins the circulation passage 4 on an upstream side of the circulation pump 11. The water supply passage 19 supplies tap water to the heat exchanger 20 for supplying hot water.

The hot water supply passage 21 supplies hot water heated by the heat exchanger 20 for supplying hot water to a hot-water tap or the like as indicated by an arrow HW.

Further, the heating and hot-water-supply apparatus 1 includes a control part 5 that controls a heating operation and the like, and the above-described equipment including the control part 5, and the like are accommodated in a case 9. An operation terminal 6 which is an operation part of the heating and hot-water-supply apparatus 1 is communicatively connected to the control part 5 and, for example, is disposed in a room in which a heating terminal is installed. In addition, an outside air temperature sensor 30 disposed outdoors is communicatively connected to the control part 5.

Next, the circulation passage 4 will be described.

The circulation passage 4 includes a first temperature sensor 13 between the circulation pump 11 and the heat exchanger 10, and includes a second temperature sensor 14 on a downstream side of the heat exchanger 10. The first temperature sensor 13 detects the temperature of the heating heat medium flowing into the heat exchanger 10. The second temperature sensor 14 detects the temperature of the heating heat medium heated by the heat exchanger 10.

A first distribution valve 15 which is a distribution means is provided in the branch part between the circulation passage 4 and the first bypass passage 12. The first distribution valve 15 distributes the heating heat medium heated by the heat exchanger 10 into the circulation passage 4 and the first bypass passage 12 so as to be adaptable to a heating operation, a hot water supply operation, and a simultaneous heating and hot-water-supply operation, and a distribution ratio thereof is adjustable. The heating heat medium distributed to the circulation passage 4 by the first distribution valve 15 is supplied to the heating terminal as indicated by an arrow HS.

A pressure release valve 16 for releasing pressure inside the circulation passage 4 is provided between the heat exchanger 10 and the first distribution valve 15. A heating return temperature sensor 17 that detects the temperature of the heating heat medium returning from the heating terminal as indicated by an arrow HR is provided on an upstream side of the circulation pump 11. A supplementary passage 18 for supplementing the heating heat medium as indicated by an arrow R is connected between the circulation pump 11 and the heating return temperature sensor 17.

Next, the heat exchanger 20 for supplying hot water will be described.

The heat exchanger 20 for supplying hot water provided in the first bypass passage 12 is a plate type heat exchanger. The plate type heat exchanger is configured such that a plurality of heat exchange plates are stacked and a passage is formed between the heat exchange plates. In the heat exchanger 20 for supplying hot water, the heating heat medium and tap water supplied from the water supply passage 19 alternately flow through the passages between the heat exchange plates so as to face each other without being mixed with each other. Irregularities are formed in the heat exchange plates in order to enlarge a surface area and improve heat exchange efficiency.

Next, the water supply passage 19 and the hot water supply passage 21 will be described.

The water supply passage 19 includes a second distribution valve 23, a flow rate regulating valve 24, a hot water supply flow rate sensor 25, and an inflow water temperature sensor 26. Tap water is supplied to the water supply passage 19 as indicated by an arrow CW through opening of a hot-water tap or the like. A second bypass passage 22 branches from the water supply passage 19, a second distribution valve 23 disposed in the branch part distributes tap water into the water supply passage 19 and the second bypass passage 22, and a distribution ratio thereof is adjustable. Therefore, the second distribution valve 23 serves as a flow rate regulating means that adjusts a flow rate of tap water flowing through the second bypass passage 22. The flow rate regulating valve 24 adjusts a flow rate of tap water flowing into the second distribution valve 23. The hot water supply flow rate sensor 25 which is a hot water supply flow rate detection means detects a flow rate of tap water to be supplied. The inflow water temperature sensor 26 which is a tap water temperature detection means detects the temperature of tap water flowing into the second distribution valve 23.

The hot water supply passage 21 joins the second bypass passage 22 at a joining part C. A hot water discharge temperature sensor 27 which is a hot water discharge temperature detection means is provided between the joining part C and the heat exchanger 20 for supplying hot water. The hot water discharge temperature sensor 27 detects the temperature of hot water which is discharged from the heat exchanger 20 for supplying hot water.

A hot water supply temperature sensor 28 which is a hot water supply temperature detection means is provided at an end on a downstream side of the hot water supply passage 21. The hot water supply temperature sensor 28 detects the hot water supply temperature of hot water supplied, the hot water being a mixture of hot water heated by the heat exchanger 20 for supplying hot water and tap water flowing through the second bypass passage 22. In the hot water supply operation, the second distribution valve 23 is controlled such that the hot water supply temperature is set to be a hot water supply set temperature.

Next, the control part 5 will be described. Although not shown in the drawing, the control part 5 is connected so as to be able to receive detection signals of the first temperature sensor 13 and the like provided in the heating and hot-water-supply apparatus 1, rotation speeds of the blower fan 3 and the like, and the like as detection parameters and set setting parameters such as rotation speeds, distribution ratios, and the like of the blower fan 3, the first distribution valve 15, and the like. In addition, the blower fan 3, the circulation pump 11, the first distribution valve 15, and the like are controlled on the basis of the detection parameters and the setting parameters so as to control operations including a heating operation, a hot water supply operation, and a simultaneous heating and hot-water-supply operation. When a request for a hot water supply operation has been given, the control part 5 calculates a necessary heating capacity (a necessary amount of heat per unit time) which is required for the hot water supply operation on the basis of the detection parameters and the setting parameters. Further, the necessary heating capacity is compared with a predetermined reference capacity to perform determination for permitting or prohibiting a simultaneous heating and hot-water-supply operation.

The necessary heating capacity is calculated on the basis of a hot water supply set temperature as a setting parameter, the temperature of tap water detected by the inflow water temperature sensor 26 and a hot water supply flow rate detected by the hot water supply flow rate sensor 25 as a detection parameter. For example, in a case where the hot water supply set temperature is 42° C., the temperature of tap water is 16° C., and the hot water supply flow rate is 10 L/min, a necessary heating capacity per hour is $(42-16)\times 10\times 60=15600$ kcal/h (=18.1 kW), and is equivalent to No. 10.4 when converted into a number.

The predetermined reference capacity is previously set to a heating capacity of hot water supply having a certain degree of margin so as to be capable of stably supplying hot water without significantly changing a hot water supply temperature detected by the hot water supply temperature sensor 28 when a hot water supply load increases due to an increase in a hot water supply flow rate, a rise in a hot water supply set temperature, a fall in a tap water temperature, or the like. For example, a proportion equivalent to 80% of a maximum hot water supply heating capacity of the heating and hot-water-supply apparatus 1 may be set as the predetermined reference capacity. Regarding a heating capacity of the heating and hot-water-supply apparatus 1, the control part 5 determines that a simultaneous heating and hot-water-supply operation can be performed when the necessary heating capacity is less than the predetermined reference capacity, and determines that a simultaneous heating and hot-water-supply operation cannot be performed when the necessary heating capacity is equal to or greater than the predetermined reference capacity. In addition, a value equivalent to a heating capacity usable for a heating operation can be obtained by taking a heat exchange efficiency of the heat exchanger 20 for supplying hot water into consideration in a remaining heating capacity obtained by subtracting the necessary heating capacity from the maximum hot water supply heating capacity of the heating and hot-water-supply apparatus 1.

Next, the operation terminal 6 will be described.

The operation terminal 6 includes a display part 7 which is capable of displaying, for example, a temperature, operation conditions, and the like, a switch part 8 for performing an operation of setting a heating temperature and a hot water supply temperature, an operation of starting a heating operation, and the like, and a sound output part, not shown in the drawing, which outputs an alarm sound and the like.

Although not shown in the drawing, the switch part 8 is provided with a switch for previously prohibiting a simultaneous heating and hot-water-supply operation (hereinafter, referred to as a simultaneous operation prohibition SW) in a case where a situation where a simultaneous heating and hot-water-supply operation cannot be performed continues due to a low tap water temperature and a low temperature, for example, in the winter season. When the simultaneous operation prohibition SW is turned on, a simultaneous heating and hot-water-supply operation prohibition state is set, and when the simultaneous operation prohibition SW is turned off, a simultaneous heating and hot-water-supply operation permissible state is set. When the simultaneous heating and hot-water-supply operation prohibition state is set, "simultaneous heating and hot-water-supply operation prohibition" is displayed on the display part 7 and is notified to a user. A notice may be given using an output such as a sound.

Next, a flow of operation control of the heating and hot-water-supply apparatus 1 using the control part 5 will be described on the basis of a flowchart of FIG. 2. The control part 5 repeatedly executes the operation control during the operation and operation standby of the heating and hot-water-supply apparatus 1. In the drawing, Si (i=1, 2, . . . ) represents a step.

First, in S1, it is determined whether or not a hot water supply operation request has been given. In a case where a determination result is Yes, the processing proceeds to S2, and in a case where a determination result is No, the processing proceeds to S12.

Next, in S2, it is determined whether or not the simultaneous operation prohibition SW is in an OFF state (a simultaneous heating and hot-water-supply operation permissible state). In a case where a determination result is Yes, the processing proceeds to S3 to calculate a necessary heating capacity which is required for a hot water supply operation on the basis of a hot water supply set temperature, the temperature of tap water, and a hot water supply flow rate as setting parameters and detection parameters, and the processing proceeds to S4. In a case where a determination result is No, the simultaneous heating and hot-water-supply operation is prohibited by the simultaneous operation prohibition SW (S10), and thus the processing proceeds to S11 to return to executing a hot water supply operation.

Next, in S4, regarding a heating capacity of the heating and hot-water-supply apparatus 1, it is determined whether or not a simultaneous heating and hot-water-supply operation can be performed on the basis of the necessary heating capacity calculated in S3 and a predetermined reference capacity. In a case where a determination result is Yes, the processing proceeds to S5, and in a case where a determination result is No, the processing proceeds to S10.

Next, in S5, it is determined whether or not a heating operation request has been given. In a case where a determination result is Yes, the processing proceeds to S6. In a case where a determination result is No, a heating operation is not executed (S10), and thus the processing proceeds to S11 to return to executing a hot water supply operation.

Next, in S6, it is determined whether or not a hot water supply set temperature is less than a heating set temperature+$\alpha$° C. at which heating at a heating set temperature can be performed even when a heating heat medium is heated in order to supply hot water at the hot water supply set temperature. In a case where a determination result is Yes, the processing proceeds to S7, and in a case where a determination result is No, the processing proceeds to S10.

Next, in S7, it is determined whether or not all of the detection parameters are within a normal range. In S7, it is determined whether or not a defect has occurred in the heating and hot-water-supply apparatus 1. In a case where a determination result is Yes (a defect has not occurred), the processing proceeds to S8, and in a case where a determination result is No (a defect has occurred), the processing proceeds to S10.

Next, a simultaneous heating and hot-water-supply operation is permitted in S8, the processing proceeds to S9, and the processing returns to a simultaneous heating and hot-water-supply operation being executed in S9. On the other hand, in a case where a determination result is No in S4, S6, or S7, a simultaneous heating and hot-water-supply operation is prohibited in S10, the processing proceeds to S11, and the processing returns to a hot water supply operation being executed in S11.

Further, in a case where a determination result in S1 is No, it is determined in S12 whether or not a heating operation request has been given. In a case where a determination result is Yes, the processing returns to S13 to execute a heating operation. In a case where a determination result is No, an operation request has not been given, and thus the processing proceeds to S14 to return to an operation standby state being set.

Next, operations and effects of the heating and hot-water-supply apparatus 1 will be described.

Figure 2:
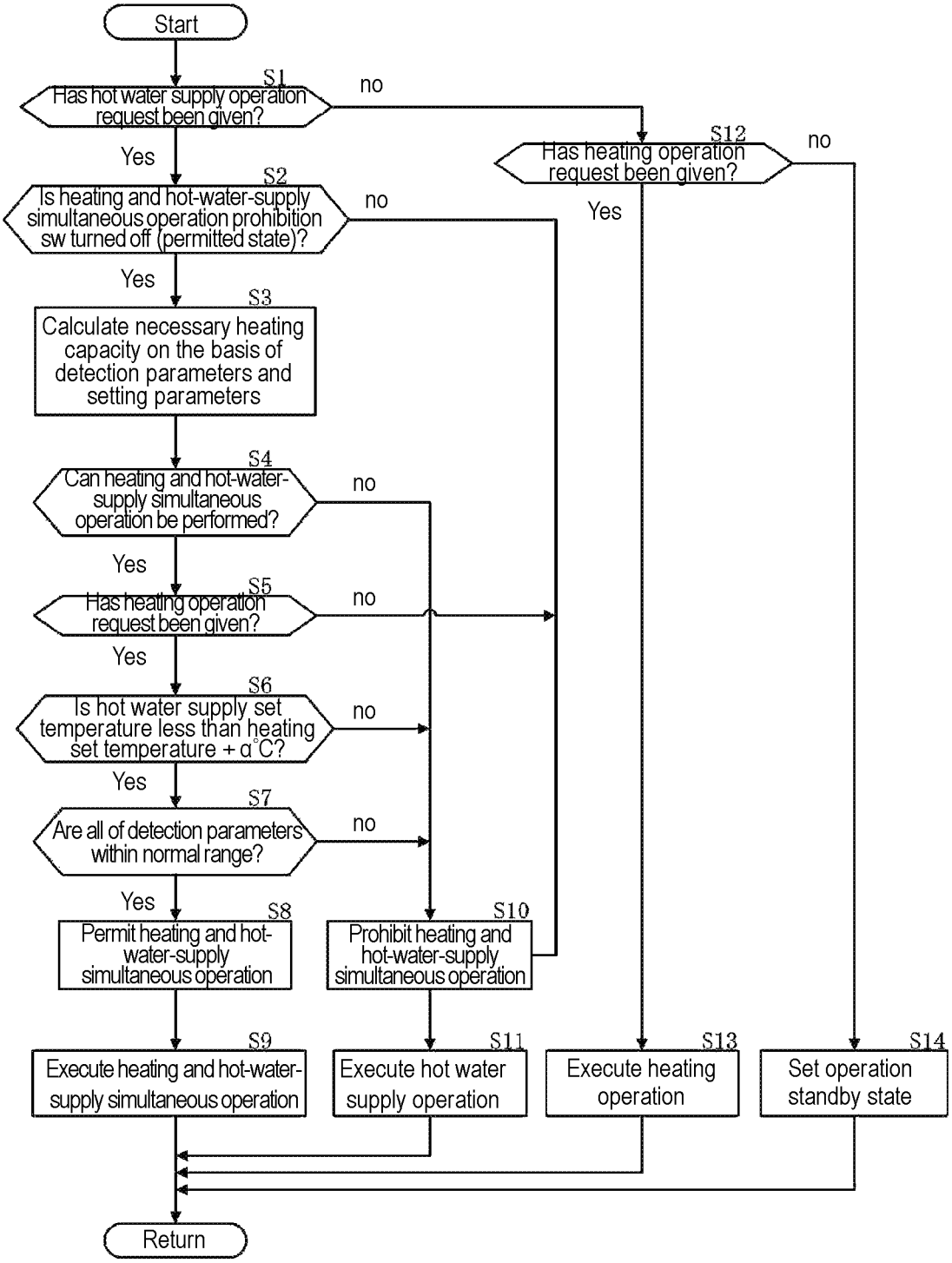
FIG. 2 is a flowchart showing a flow of operation control using a control part according to an example.

For example, when a heating operation request has been given by operating the operation terminal 6 at the time of operation standby of the heating and hot-water-supply apparatus 1, the control part 5 adjusts the first distribution valve 15 so that a heating heat medium flows to only the circulation passage 4 side, and executes a heating operation (see S12 and S13 in FIG. 2). In this case, the control part 5 sets setting parameters on the basis of a plurality of detection parameters such as temperatures of the heating heat medium which are detected by the first and second temperature sensors 13 and 14, and the like, a rotation speed of the blower fan 3, and the like to control the heating operation so that the heating heat medium is heated to a heating set temperature+β° C. (for example, β=25) which is optimum for the heating operation in accordance with a heating set temperature.

When a hot-water tap or the like is opened and a hot water supply operation request has been given due to the detection of a flow rate equal to or greater than a predetermined flow rate of the hot water supply flow rate sensor 25, the control part 5 calculates a necessary heating capacity required for a hot water supply operation when the simultaneous operation prohibition SW is turned off (see S1 to S3 in FIG. 2). Further, regarding a heating capacity of the heating and hot-water-supply apparatus 1, in a case where it is determined that a simultaneous heating and hot-water-supply operation cannot be performed on the basis of the calculated necessary heating capacity and a predetermined reference capacity, the control part 5 prohibits a simultaneous heating and hot-water-supply operation (see S10 in FIG. 2). In addition, the control part 5 gives a notice of the prohibition of a simultaneous heating and hot-water-supply operation by using the operation terminal 6. In addition, generally, a hot water supply operation is terminated in a short period of time in many cases as compared with a heating operation. For this reason, since a significant influence is not exerted on a user even when a heating operation is temporarily stopped during a hot water supply operation, and it is also considered that the user does not recognize it in many cases, setting may be performed such that the prohibition of a simultaneous heating and hot-water-supply operation is not notified.

Even when a simultaneous heating and hot-water-supply operation is prohibited, the control part 5 adjusts the first distribution valve 15 so that a heating heat medium flows to only the first bypass passage 12 side in response to a hot water supply operation request, and executes a hot water supply operation (see S11 in FIG. 2). Hot water to be supplied is heated through heat exchange with the heating heat medium by the heat exchanger 20 for supplying hot water. The control part 5 sets setting parameters on the basis of a plurality of detection parameters such as a hot water supply set temperature and a hot water supply temperature detected by the hot water supply temperature sensor 28 or the like to control the hot water supply operation and supplies hot water at the hot water supply set temperature.

The simultaneous heating and hot-water-supply operation is prohibited on the basis of the necessary heating capacity calculated by the control part 5, so that it is possible to stably supply hot water by performing heating so as to follow a fluctuation in a hot water supply load in a state where a margin is given to a heating capacity for a hot water supply operation, and thus the user can be prevented from feeling inconvenience or discomfort. In addition, since the prohibition of the simultaneous heating and hot-water-supply operation is notified, it is possible to reduce discomfort due to inability to simultaneously use heating and hot water supply, and it is advantageous for the user to take a measure for avoiding the prohibition of a simultaneous heating and hot-water-supply operation such as a reduction in a hot water supply flow rate. Additionally, since a hot water supply operation is executed even when a simultaneous heating and hot-water-supply operation is prohibited, it is possible to prevent the user from feeling inconvenience or discomfort due to non-supply of hot water.

In a case where the control part 5 determines that a simultaneous heating and hot-water-supply operation can be performed and both a heating operation request and a hot water supply operation request have been given, the control part 5 permits and executes the simultaneous heating and hot-water-supply operation when a hot water supply set temperature is less than a heating set temperature+α° C. and all of the detection parameters are in a normal range (see S5 to S9 in FIG. 2). In this case, the control part 5 adjusts the first distribution valve 15 so that a heating heat medium flows to only the first bypass passage 12 when a temperature detected by the hot water supply temperature sensor 28 is not a temperature approximate to a hot water supply set temperature to thereby execute only a hot water supply operation, and adjusts a distribution ratio of the second distribution valve 23 in order to supply hot water at the hot water supply set temperature. Thereby, it is possible to rapidly supply hot water at the hot water supply set temperature. When a temperature detected by the hot water supply temperature sensor 28 becomes approximate to the hot water supply set temperature, the control part 5 adjusts the first distribution valve 15 so that the heating heat medium also circulates in the circulation passage 4. In addition, the approximate temperature is a temperature, for example, in a range from −3° C. to +3° C. with respect to the hot water supply set temperature, but this range can be appropriately set.

On the other hand, when the hot water supply set temperature is equal to or higher than the heating set temperature+α° C. or at least one detection parameter falls outside a normal range, the control part 5 prohibits a simultaneous heating and hot-water-supply operation and executes only a hot water supply operation (see S10 and S11 in FIG. 2). For example, in a case where operation is performed by heating the heating heat medium to 50° C. (β=25) as an optimum temperature at the time of a heating operation in which a heating set temperature is 25° C., the heating heat medium is heated to a temperature higher than 60° C. when a high-temperature hot water supply operation in which a hot water supply set temperature is 60° C. is started. Even when the control part 5 determines that the high-temperature hot water supply operation and the heating operation can be simultaneously performed on the basis of the calculated necessary heating capacity, a simultaneous heating and hot-water-supply operation is prohibited in a case where heating at the heating set temperature cannot be performed when, for example, the temperature of the heating heat medium is not less than 55° C. (α=30). Therefore, a heating temperature does not rise, and the user can be prevented from feeling discomfort or the like.

Further, in a case where a detection parameter of the circulation pump 11 is not set to be a setting parameter which is set by the control part 5, for example, in a case where a rotation speed of the circulation pump 11 does not fall within a normal range of −20% to +20% with respect to a set rotation speed, there is a possibility that a defect related to the circulation pump 11 may have occurred. In this case, the heating and hot-water-supply apparatus 1 cannot output a necessary heating capacity calculated by the control part 5, and there is a concern that hot water at the hot water supply set temperature may not be supplied even when a simultaneous heating and hot-water-supply operation is executed, and thus the simultaneous heating and hot-water-supply operation is prohibited to execute a hot water supply operation. Thereby, it is possible to prevent the user from feeling discomfort or the like as much as possible. In addition, a normal range can be appropriately set for each setting item such as a range of −20% to +20% with respect to rotation speeds and power consumption of the blower fan 3 and the circulation pump 11 and a range of −3° C. to +3° C. with respect to the temperature of the heating heat medium and the like.

Next, an example in which the above-described example is partially modified will be described.

Figure 3:
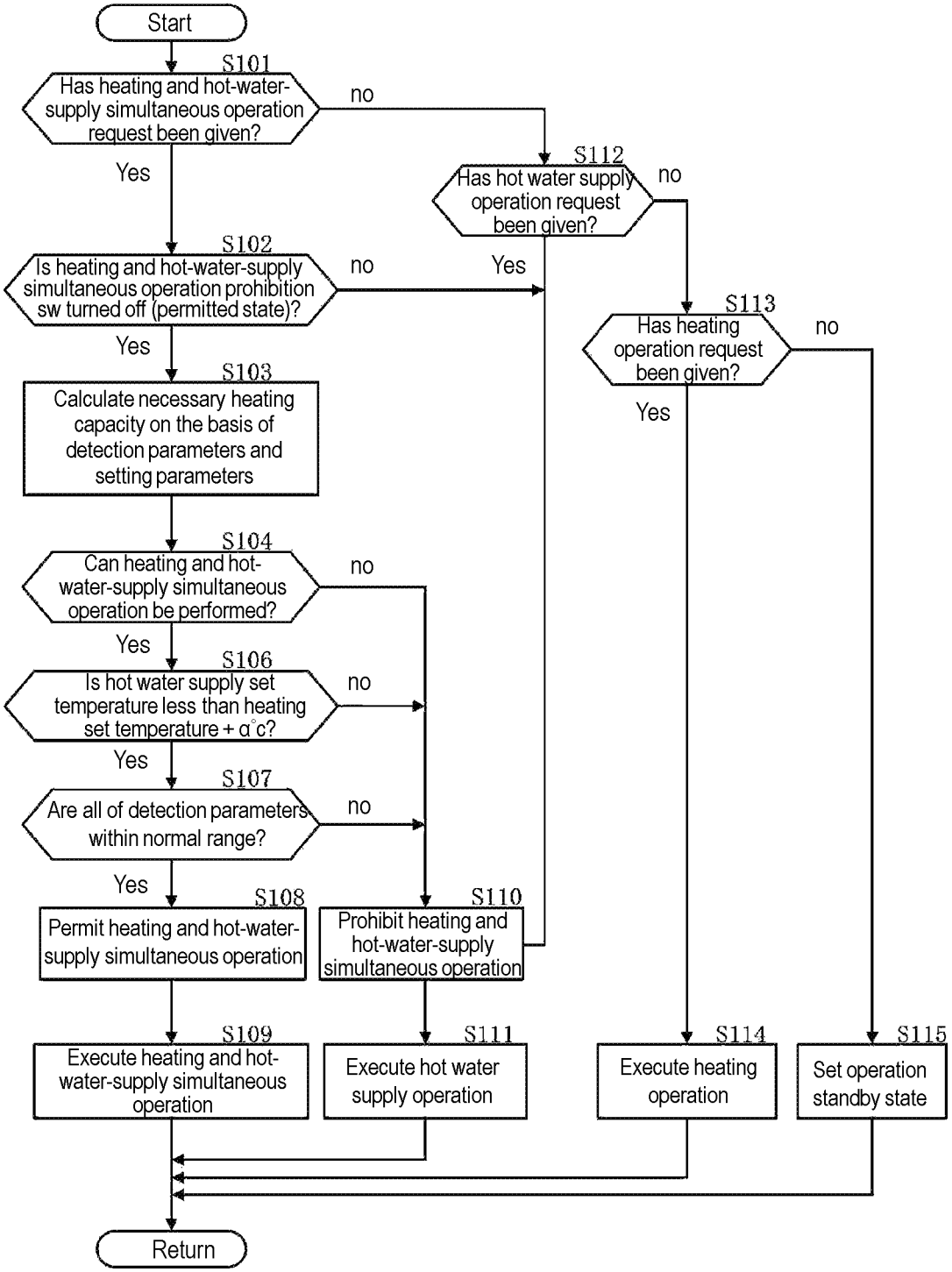
FIG. 3 is a flowchart showing an example in which a portion of the example is modified.

[1] The control part 5 may calculate a necessary heating capacity required for a hot water supply operation only in a case of a simultaneous heating and hot-water-supply operation (see FIG. 3). Also in this case, when it is determined that the simultaneous heating and hot-water-supply operation cannot be performed on the basis of the calculated necessary heating capacity and a predetermined reference capacity, it is possible to stably supply hot water by prohibiting the simultaneous heating and hot-water-supply operation, and thus a user can be prevented from feeling inconvenience or discomfort.

[2] In a case where a heating operation request has been given, a heating necessary heating capacity required for a heating operation may be calculated on the basis of a setting parameter such as a heating set temperature and a detection parameter such as a heating heat medium temperature, and a simultaneous heating and hot-water-supply operation may be permitted or prohibited on the basis of the heating necessary heating capacity, a necessary heating capacity of a hot water supply operation, and a reference capacity.

[3] Besides, one of ordinary skill in the art can implement the present invention in the form of adding various changes to the embodiment without deviating from the scope of the invention, and thus the present invention includes such changed forms.

What is claimed is:

1. A heating and hot-water-supply apparatus comprising:

combustion means;

a heat exchanger;

a circulation passage which connects the heat exchanger and an external heating terminal;

a circulation pump which is provided in the circulation passage;

a bypass passage which branches from the circulation passage and bypasses the heating terminal;

distribution means which is provided in a branch part between the circulation passage and the bypass passage;

a heat exchanger for supplying hot water which is provided in the bypass passage;

a water supply passage for supplying tap water to the heat exchanger for supplying hot water;

a hot water supply passage for supplying hot water heated by the heat exchanger for supplying hot water at a predetermined hot water supply set temperature;

a plurality of detection means;

a switch for performing a predetermined operation; and a controller for performing control based on setting parameters set by the switch and detection parameters detected by the plurality of detection means, wherein the distribution means is configured such that a distribution ratio is adjustable so as to be adaptable to a heating operation, a hot water supply operation, and a simultaneous heating and hot-water-supply operation, and the controller is configured to calculate a necessary heating capacity required for the hot water supply operation on the basis of the setting parameters and the detection parameters and prohibit the simultaneous heating and hot-water-supply operation in a case where the necessary heating capacity is equal to or greater than a predetermined reference capacity, the controller is further configured to prohibit the simultaneous heating and hot-water-supply operation based on the hot water supply set temperature being not less than the heating set temperature+$\alpha$° C., wherein $\alpha$ is greater than 0.

2. The heating and hot-water-supply apparatus according to claim 1, wherein the controller is configured to give notice of prohibition of the simultaneous heating and hot-water-supply operation through an alarm in a case where the simultaneous heating and hot-water-supply operation is prohibited.

3. The heating and hot-water-supply apparatus according to claim 1, wherein the controller is configured to execute the hot water supply operation in a case where a request for performing both the heating operation and the hot water supply operation has been given when the simultaneous heating and hot-water-supply operation is prohibited.

4. The heating and hot-water-supply apparatus according to claim 2, wherein the controller is configured to execute the hot water supply operation in a case where a request for performing both the heating operation and the hot water supply operation has been given when the simultaneous heating and hot-water-supply operation is prohibited.

* * * * *